United States Patent [19]

Kingsley

[11] 4,308,841

[45] Jan. 5, 1982

[54] EMISSION CONTROL SYSTEM WITH INTEGRATED EVAPORATIVE CANISTER PURGE

[75] Inventor: Charles A. Kingsley, Sterling Heights, Mich.

[73] Assignee: General Motors Corporation, Detroit, Mich.

[21] Appl. No.: 764,866

[22] Filed: Feb. 2, 1977

[51] Int. Cl.[3] ..... F02M 37/02

[52] U.S. Cl. ..... 123/520

[58] Field of Search ..... 123/119 A, 136, 520

[56] References Cited

U.S. PATENT DOCUMENTS

| | | | |
|---|---|---|---|
| 3,752,134 | 8/1973 | Hollis | 123/136 |
| 3,762,384 | 10/1973 | Day et al. | 123/119 A |
| 3,935,850 | 2/1976 | King | 123/136 |
| 4,031,869 | 6/1977 | Onishi et al. | 123/136 X |
| 4,044,743 | 8/1977 | Eaton | 123/136 |

*Primary Examiner*—Michael Koczo, Jr.

*Attorney, Agent, or Firm*—Arthur N. Krein

[57] ABSTRACT

In an emission control system for a vehicle powered by an internal combustion engine, the purge of fuel vapor from a canister containing fuel vapor is effected through a purge valve operated by a control vacuum signal, as controlled by operation of a thermal vacuum switch, which signal is also applied to an exhaust gas recirculating valve, acting on one side of a diaphragm in the purge valve, the diaphragm being operative to control flow of fuel vapor supplied to a compartment on the opposite side of the diaphragm via a restricted inlet passage from the canister to a passage having a positive crankcase ventilation vacuum signal applied thereto with flow through the passage controlled by movement of the diaphragm.

4 Claims, 2 Drawing Figures

EMISSION CONTROL SYSTEM WITH INTEGRATED EVAPORATIVE CANISTER PURGE

Figure 1:
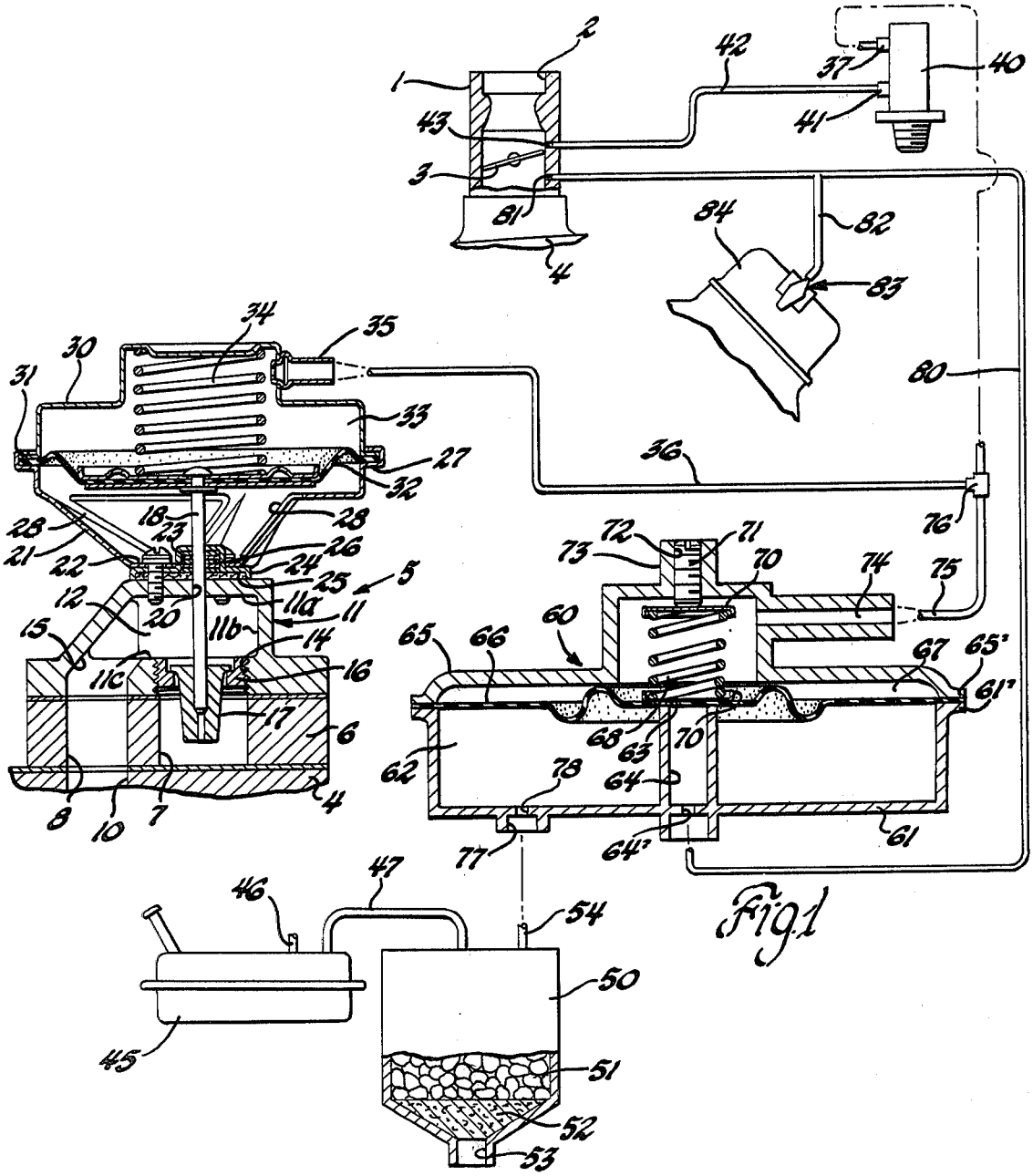

This invention relates to an emission control system for an automotive vehicle and, in particular, to such a system having an integrated evaporative canister purge valve incorporated therein.

As is well known, the emission control system associated with the internal combustion engine of an automotive vehicle normally consists of various sub-systems. For example, such a system would include an exhaust gas recirculation (EGR) sub-system which is used to reduce oxides of nitrogen ($NO_x$) emitted from the engine exhaust. In such a system, a vacuum modulated shut-off and metering valve, commonly referred to as an "EGR valve" is installed on the inlet manifold to control the flow of exhaust gases recirculated for induction back into the engine. The EGR valve, which may, for example, be of the type disclosed in U.S. Pat. No. 3,762,384 entitled "Exhaust Gas Recirculation Valve", issued Oct. 2, 1973 to Edward G. Day and Ernst L. Ranft, contains a vacuum diaphragm, which is operated by a control vacuum or ported intake manifold vacuum, as applied via a normally closed thermal vacuum switch, that is operative to open at a predetermined temperature of a selected component of the engine.

Another such sub-system provides positive crankcase ventilation which is used to withdraw oil vapor and gas vapor from the various cavities throughout the engine for burning in the engine. These vapors are removed from the crankcase utilizing engine induction vacuum to draw fresh air, for example, from the clean air side of an air cleaner on the carburetor of the engine through the engine crankcase with this flow being regulated by a valve commonly referred to as a PCV valve, mounted on the engine rocker arm cover, for example, and which is operative to vary the amount of flow through this system according to the various modes of operation of the engine.

Another sub-system is the system used for controlling loss of fuel vapor from the vehicle fuel tank, which is referred to as an evaporative emission control system. In this system, a canister containing, for example, activated carbon is connected to the vent or vents of the fuel tank and it is used to store the fuel vapor emitted from the fuel tank and of fuel vapor delivered from the float bowl of a carburetor, if a carburetor is being used on the engine. In vehicle operation, the fuel vapor is purged from the canister into the engine induction system through, for example, a suitable vapor regulating or purge valve which may be actuated, for example, by a ported engine vacuum signal. Such an evaporative emission control system may be of the type disclosed, for example, in U.S. Pat. No. 3,683,597 entitled "Evaporation Loss Control", issued Aug. 15, 1972 to Thomas R. Beveridge and Ernst L. Ranft.

Various other evaporative loss control devices have been proposed and utilized whereby the fuel vapors are contained and then delivered to the intake manifold of the engine during operation thereof for consumption therein. These various devices have worked successfully to help reduce the emission of fuel vapors directly from the fuel system but, under certain engine operating conditions, this feed-back of the fuel vapors for consumption in the engine has effected engine operation or has increased the exhaust emission of unburned hydrocarbons discharged from the engine, or both.

It is therefore the principal object of this invention to improve an emission control system for a vehicle powered by an internal combustion engine in which an evaporative canister purge sub-system is integrated with other components of an emission control system associated with the engine.

Another object of this invention is to improve a vapor regulating valve for use in a system for purging fuel vapors, which vapor regulating valve is operative so as to provide for purge flow modulation.

A still further object of this invention is to provide an improved integrated evaporative canister purge system which is operative to provide for thermal control purge and which is shut-off during diurnal and hot soak conditions of the engine.

Figure 2:
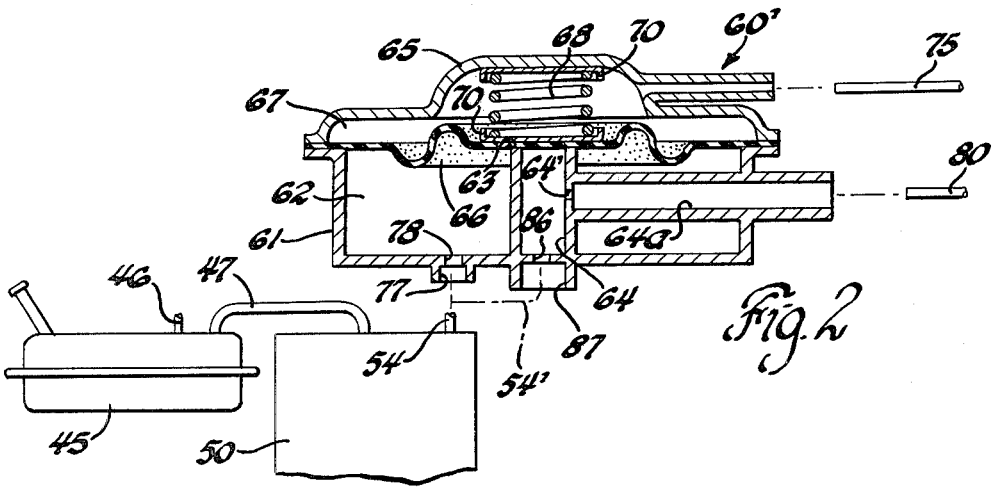

For a better understanding of the invention, as well as other objects and further features thereof, reference is had to the following detailed description of the invention to be read in connection with the accompanying drawings, wherein:

FIG. 1 is a schematic view, with parts in section, of various components of an emission control system for an engine and of the fuel system for the engine, which system has a preferred embodiment of an evaporative canister purge valve integrated therein, in accordance with the subject invention; and, FIG. 2 is a schematic view of a portion of the engine fuel system of FIG. 1 utilizing an alternate embodiment of an evaporative canister purge valve arrangement in accordance with the invention, which valve is shown in section.

Referring first to FIG. 1, there is shown various components of an emission control system as used with the internal combustion engine of, for example, a motor vehicle. The engine has a carburetor throttle body 1, with an induction passage 2 therethrough with flow of an air-fuel mixture, or air alone in the case of a fuel injected engine, through the induction passage being controlled by a throttle valve 3, mounted on the intake manifold 4 of the engine.

As part of the emission control system for the engine, there is provided an exhaust gas recirculating valve, generally indicated by the reference numeral 5, which can be mounted directly to the intake manifold or, as shown, mounted on an insert plate 6 which, in turn, is suitably secured to the intake manifold 4. The insert plate 6 is provided with a first chamber 7 therein which is in flow communication with an exhaust crossover passage, not shown, in the intake manifold 4 and a second chamber 8 which is in flow communication with a riser bore 10 extending from the usual induction passage in the intake manifold 4.

In the construction illustrated, the exhaust gas recirculating valve 5 is of the type disclosed in the above-identified U.S. Pat. No. 3,762,384, the disclosure of which is incorporated herein by reference thereto. As shown, the valve 5 comprises a base member 11 having an upper wall 11*a*, a peripheral wall 11*b* and a lower wall 11*c* which define a chamber 12. The chamber 12 has an inlet opening 14 from the first chamber 7 and an outlet opening 15 to the second chamber 8 extending through the lower wall 11*c*. A valve seat member 16 is threadedly secured to the lower wall 11*c* in the inlet opening 14. A valve pintle 17 has a generally conical contour cooperating with valve seat member 16 to provide a variable area for flow of recirculated exhaust gases. Valve pintle 17 is suitably retained on the lower end of valve stem 18 which extends upwardly through an opening 20 in the upper wall of the base member 11.

A housing member 21 has a central base portion 22 provided with an enlarged opening 23 to receive an intermediate member 24 having its annular downwardly concave, lower dished portion disposed between the central portion 22 of housing member and the upper wall of base member 11. An asbestos insulating disk 25 is received in the lower dished portion of the intermediate member 24 and reduces conduction of exhaust heat from base member 11 to housing member 21. Intermediate member 24 also has a central downwardly concave upper cup portion with a central opening therein receiving valve stem 18. A plurality of suitable sealing and guide disks 26 are received in this upper cup portion of intermediate member 24 and slidably engage the valve stem 18 to guide it and to reduce air flow into chamber 12. As shown, the housing member 21 is provided with an outer annular rim 27 supported by a plurality of outwardly and upwardly extending spokes 28 of this member, only two such spokes being shown.

A cover member or diaphragm cover 30, of inverted cup-shaped, has a rim 31 secured about the rim 27 of housing member 21 and a diaphragm 32 is clamped between these rims to define a vacuum chamber 33 on one side thereof. As shown, the valve stem 18 is suitably secured to the diaphragm 32 for movement therewith. A spring 34 is positioned within the cover member 30 with one end thereof in abutment against the cover member and its opposite end abutting against the diaphragm 32 to normally bias the valve pintle 17 into seating engagement against the valve seat member 16. A vacuum tube coupling 35 is connected to the cover member 30 to provide a vacuum inlet to the chamber 33, a hose 36 being connected to the free end of this coupling and to a first port 37 of a thermal vacuum switch 40. A second port 41 of the thermal vacuum switch 40 is connected by a hose conduit 42 to the induction passage 2 at a port 43 disposed so as to be transversed by the throttle valve 3 during opening movement thereof. The thermal vacuum switch 40, which is responsive to the operating temperature of the engine, is suitably mounted, for example, on the engine or the exhaust system thereof so as to prevent operation of the exhaust gas recirculating valve 5 below a predetermined operating temperature condition of the engine.

The engine receives fuel from a reservoir or fuel tank 45 through a conduit 46 in a conventional manner. The reservoir or fuel tank 45 has at least one vent line 47 which extends, preferably via a liquid vapor separator, not shown, to an evaporative canister 50 that contains an adsorbent, such as carbon 51, which stores the fuel vapor therein. The carbon 51 is suitably supported within the canister above a filter pad 52, for example, of polyurethane, which filters purge air entering through an opening 53 at the base of the canister.

Fuel vapor, purged from the canister 50, is delivered out through a discharge conduit 54 of the canister for delivery to the induction passage 2 via a purge valve 60 which controls the flow thereof and which is integrated with other elements or components of the emission control system in a manner to be described in accord with the subject invention.

The preferred embodiment of the purge valve 60, as shown in FIG. 1, includes a cup-shaped base 61 providing a first compartment 62 having an upstanding valve seat 63 therein, as provided by an annular boss that has a passage 64 extending therethrough and having an orifice 64', of predetermined size therein. A cover member 65, of inverted, substantially cup-shape, is suitably secured to the base 61 and a flexible diaphragm 66 is suitably sandwiched at its outer peripheral edges between the opposing flanges 61' and 65' of the base 61 and cover member 65, respectively. The diaphragm 66 forms with the cover member 65 a vacuum chamber 67 and separates this chamber 67 from the compartment 62 of the base. A coil spring 68 is positioned within the chamber 67 to have one end thereof abut against a first spring retainer disk 70 in abutment on one side and centrally of the diaphragm 66 and to have its other end against a second spring retainer disk 70 which, in turn, abuts against one end of an adjusting screw 71 in engagement with the threaded bore 72 of a central boss 73 of the cover member. With this arrangement, the diaphragm is normally positioned against the valve seat 63 blocking flow through the passage 64.

The cover member is also provided with a signal vacuum passage 74, which at one end is in communication with the vacuum chamber 67 and at its other end is connected by a hose 75 and a T-connection 76 to the hose 36 whereby a ported or controlled vacuum signal can be applied to the vacuum chamber 67.

The compartment 62 of the base 61, which is separated by the diaphragm 66 from the chamber 67, is provided with an inlet passage 77, having an orifice 78, of predetermined size, therein, which is suitably connected to the discharge conduit 54 of canister 50.

As illustrated, the valve seat 63 is substantially centered relative to the compartment 62 and the boss on which it is formed is of a predetermined outside diameter and, the passage 64 therethrough is also of a predetermined diameter, for a purpose which will become apparent. Passage 64 is connected by a conduit 80 to be in communication with the induction passage 2 via a port 81 positioned below the throttle valve 3. Conduit 80 is also provided with a branch, such as conduit 82, for delivery of crankcase fumes into the induction passage 2. In the construction shown, the branch conduit 82 is connected to one end of a conventional, positive crankcase ventilation valve, generally designated 83, which is suitably fixed, in the construction shown, to the rocker arm cover 84 of the engine.

Again with reference to FIG. 1, all of the elements in this Figure are shown in their at rest position. In this condition, the diaphragm 66 of the purge valve 60 is biased by the spring 68 into sealing engagement with the valve seat 63 thereby blocking flow of fuel vapors out from the purge valve to the induction passage 2.

During engine operation, the ported, control vacuum signal, as sensed at the port 43, is applied to the thermal vacuum switch 40 but, assuming that the engine is cold, no flow will be allowed through this switch until it senses a predetermined operating temperature condition of the engine, at which time, this switch will be actuated to interconnect the first and second ports thereof in flow communication with each other. At the same time, engine induction vacuum, as sensed at the port 81 in the induction passage 2, is in communication with the positive crankcase ventilation valve 83, to permit operation of this valve 83, in a well-known conventional manner, which need not be described in detail herein since it forms no part of the subject invention. This induction vacuum pressure is also applied via the conduit 80 and passage 64 to a portion on one side of the purge valve diaphragm 66. However, the diaphragm 66 is still operatively seated against the valve seat 63, as biased by spring 68, so that there is no flow of fuel vapor to the induction passage 2. It will thus be readily apparent that one of the advantages of the subject system is that of thermal control purge. That is, the control signal applied to the chamber 67 of the purge valve 60 is obtained from the vacuum signal applied for exhaust gas recirculation after the thermal vacuum switch 40 is open and no purging of fuel vapor occurs in this embodiment until the engine is at some predetermined operating temperature condition.

Upon the thermal vacuum switch 40 sensing a predetermined temperature operating condition of the engine, it opens to permit a control vacuum signal to be applied to the vacuum chamber 33 of the exhaust gas recirculating valve 5 whereby this valve is operative in the manner described in the above-identified U.S. Pat. No. 3,762,384. At the same time, this ported, control vacuum signal is also applied to the vacuum chamber 67 of the purge valve and, as this signal develops sufficient force to overcome the preload of the spring 68 and the force of engine induction vacuum on the small area of the diaphragm 66 exposed to the induction vacuum signal via passage 64 to thereby effect unseating or opening of the diaphragm 66 relative to the valve seat 63, modulated flow of fuel vapor will begin to occur. It will be apparent that, at this time, induction vacuum is applied to the inside of canister 50 to draw purge air therethrough and air-fuel vapors therefrom.

Flow modulation is obtained because, in the just described condition, as this valve opens, the control vacuum signal is being applied to one side or top of the diaphragm 66, with reference to FIG. 1, at a signal level above the opening point for this valve arrangement, and with a reduced engine induction vacuum pressure (due to bleed through the orifices 64' and 78) is applied to the other or bottom side of the diaphragm 66. However, as the diaphragm 66 unseats from the valve seat 63, the induction vacuum present in passage 64 is then applied to the total area on the bottom side (with reference to FIG. 1) of the diaphragm 66 and the resultant force will effect closing of the diaphragm 66 against the valve seat 63. Any vacuum in the chamber 62 will then, of course, bleed through the purge restriction orifice 78 reducing the vacuum under the portion of the diaphragm 66 radially outward of the valve seat 63 so that the diaphragm 66 can again be seated relative to the valve seat 63 in the manner previously described. That is, the vacuum level in the chamber 62 will be reduced by atmospheric air bleeding through the opening 53, filter pad 52 and carbon 51 to convey with the fuel vapor from canister 50 and through the orifice passage 78 on into chamber 62 at a controlled rate, as determined by the size of the orifice passage 78. The resultant of this is a vacuum modulation which gives an increasing flow of fuel vapors from the canister 50 to the engine as a function of increasing control vacuum with the rate of increase being a function of control vacuum, engine induction vacuum, which is also applied to the positive crankcase ventilation valve 83, and of the size of the orifice 78. Of course, it will be apparent that induction vacuum flow can be regulated by changing the size of the orifice 64' restriction and that purged vapor flow can be regulated by changing the size of orifice 78 restriction, as desired, for a given engine.

Referring now to the alternate embodiment of the purge valve 60' shown in FIG. 2, this alternate embodiment of the purge valve is similar in construction to that described above with reference to FIG. 1, except that it is modified so that it is operative to permit a predetermined constant purge of fuel vapor from the canister 50, as desired for a particular engine application.

Since most of the elements of the purge valve 60' are similar to those of the purge valve 60 and, since like parts are identified by the same reference characters in both figures, a detailed discussion of the construction of the purge valve 60' is not deemed necessary and only the modification of this purge valve 60', relative to the purge valve 60, need be described.

Thus, in this alternate embodiment of the purge valve 60', shown in FIG. 2, the passage 64 in the base 61 is of T-shape and thus has a side branch portion, identified by reference **64*a*, that is connected to the conduit 80 whereby the passage 64 can be supplied with induction vacuum. Also in the particular construction shown, the orifice 64' within the passage 64 is positioned in the branch portion 64*a* of this passage. As part of the modification which is the purpose of this alternate embodiment, the passage 64 in the base 61 is formed so as to be in communication via an orifice 86, of predetermined size, with a vapor passage 87 in the base 61. The vapor passage 87 is connected by a branch conduit 54' to the conduit 54 whereby it is in flow communication with the interior of the canister 50** to receive fuel vapor therefrom.

The operation of the purge valve 60' is the same as that of the purge valve 60, as previously described, except that there will be a continual purging of fuel vapor from the canister 50, during engine operation, with this constant purging of fuel vapor controlled by induction vacuum. It will be apparent that the level of induction vacuum signal in the passage 64 of the purge valve 60' will be substantially less than that in induction passage 2 by the flow of air through the canister 50 and then of air and fuel vapor first through the constant purge orifice 86 and then through the vacuum orifice 64'.

Although the purge valves 60 and 60' are each shown as separate elements, it will be readily apparent to those skilled in the art that either of these purge valves can readily be fabricated as an integral part of the canister 50 in the manner disclosed in the above-identified U.S. Pat. No. 3,683,597.

What is claimed is:

1. A canister purge system for use as part of an emission control system for a vehicle having a canister receiving fuel vapor from a fuel reservoir used to supply fuel to an internal combustion engine, the engine having an induction passage with flow therethrough controlled by a throttle valve, the induction passage having a ported vacuum port therein traversed by the throttle valve and an induction vacuum port located below the throttle valve, said canister purge system including a purge valve having a housing including a base and a cover member, a diaphragm secured between said base and said cover member and defining a chamber with said cover on one side of said diaphragm and defining with said said base a compartment on the other side of said diaphragm, said base having an upstanding boss projecting into said compartment and defining at one end thereof a valve seat, an outlet passage, with an orifice restriction of predetermined size therein, in said base extending through said boss whereby said valve seat encircles said outlet passage, said valve seat being positioned to be engaged by said diaphragm to block flow through said outlet passage from said compartment, spring means positioned in said chamber for normally biasing said diaphragm into engagement with said valve seat, said base having a vapor inlet passage, with a purge orifice of predetermined size therein, opening at one end into said compartment and connectable at its other end to the canister for receiving fuel vapor therefrom, conduit means connecting said outlet passage with the port in the induction passage below the throttle valve, vacuum passage means in said cover in communication at one end with said chamber and, a valve controlled conduit means, including a thermal vacuum switch, operatively connected at one end to the opposite end of said vacuum passage means and at its other end to the ported vacuum port in the induction passage whereby a ported vaccum signal can be applied to the chamber side of said diaphragm, said thermal vacuum switch being positioned in thermal heat receiving relation on the engine.

2. A canister purge system according to claim 1 wherein said base of said purge valve further includes a vapor passage means in communication with said outlet passage intermediate the orifice restriction in said outlet passage and said valve seat, said vapor passage means being connectable to the canister for receiving fuel vapor therefrom and includes a purge flow orifice, of predetermined size, whereby a predetermined quantity of fuel vapor is constantly purged from the canister during operation of the engine.

3. In an emission control system for a vehicle having a fuel reservoir, an evaporative canister having an inlet connected to the fuel reservoir for receiving fuel vapor from the fuel reservoir and an outlet means, an internal combustion engine having an induction passage with flow therethrough controlled by a throttle valve, an exhaust passage, a diaphragm actuated exhaust gas recirculation valve in communication with the exhaust passage, a thermal vacuum switch positioned in thermal heat transfer relationship with the engine, the thermal vacuum switch having a port connected by a vacuum conduit means to a port opening into the induction passage to be traversed by the throttle valve and a second port connected by a control vacuum conduit means to the exhaust gas recirculation valve whereby a ported, control vacuum signal can be applied to one side of the diaphragm of the exhaust gas recirculation valve, a positive crankcase ventilation system associated with the engine for the removal of gases from the crankcase of the engine, the positive crankcase ventilation system including a positive crankcase ventilation valve and a vacuum conduit in fluid communication with the positive crankcase ventilation valve and connected to the induction passage downstream of the throttle valve whereby induction vacuum is utilized to draw fresh air through the crankcase and to draw gases from the crankcase into the induction passage and, a canister purge valve operatively connected to the canister for the controlled removal of fuel vapors from the canister, the improvement wherein said purge valve includes a valve housing having a base providing a compartment having an upstanding valve seat therein including an outlet passage means therethrough connected to said vacuum conduit, an orifice restriction of predetermined size in said outlet passage means, a cover member secured to said base, a flexible diaphragm secured between said base and said cover member for defining a chamber with said cover and for separating said compartment from said chamber, said base further having a vapor inlet with a purge orifice therein opening at one end directly into said compartment and having its other end in fluid communication with said outlet means of said canister to receive fuel vapors from said canister, spring means positioned in said chamber for normally biasing said flexible diaphragm into engagement with said valve seat and, passage means in said cover in communication at one end with said chamber and at its other end being connected to said control valve conduit means intermediate said exhaust gas recirculation valve and said thermal vacuum switch whereby a ported vacuum signal can be applied to said chamber side of said flexible diaphragm, as controlled by said thermal vacuum switch.

4. An emission control system according to claim 3 wherein said base of said purge valve further includes a second passage having a purge flow orifice therein connected at one end to said outlet passage means between said orifice restriction in said outlet passage means and said valve seat and at its other end being in communication with said outlet means of said canister whereby a constant purge of vacuum vapors from said canister can be maintained by induction vacuum controlled by said orifice restriction applied to said passage means via said vacuum conduit.

* * * * *